US006457508B1

(12) United States Patent
Tomita

(10) Patent No.: US 6,457,508 B1
(45) Date of Patent: Oct. 1, 2002

(54) SUNSHADE ROLL SCREEN

(75) Inventor: Katsuaki Tomita, Chiba (JP)

(73) Assignee: Sanwa Shutter Corporation, Tokyo (JP)

( * ) Notice: Subject to any disclaimer, the term of this patent is extended or adjusted under 35 U.S.C. 154(b) by 0 days.

(21) Appl. No.: 09/275,435

(22) Filed: Mar. 24, 1999

(30) Foreign Application Priority Data

Mar. 26, 1998 (JP) ..... 10-096910

(51) Int. Cl.[7] ..... E04F 10/06

(52) U.S. Cl. ..... 160/67; 160/70; 160/79; 135/88.12

(58) Field of Search ..... 160/59, 65, 66, 160/67, 68, 69, 70, 72, 74, 76, 78, 79, 265, 370.22, 370.23; 135/88.12, 88.1

(56) References Cited

U.S. PATENT DOCUMENTS

| | | | | | |
|---|---|---|---|---|---|
| 1,426,793 | A | * | 8/1922 | Vineberg et al. | 160/370.22 |
| 1,594,643 | A | * | 8/1926 | Stuart | 160/68 |
| 1,595,234 | A | * | 8/1926 | Kuyper | 160/242 |
| 1,749,197 | A | * | 3/1930 | Stuart | 160/70 |
| 1,890,406 | A | * | 12/1932 | Pollard | 160/68 |
| 3,074,474 | A | * | 1/1963 | Dunn | 160/68 |
| 3,722,571 | A | * | 3/1973 | Knight et al. | 160/68 |
| 4,188,964 | A | * | 2/1980 | Greer | 160/67 |
| 4,836,263 | A | * | 6/1989 | Ament | 160/68 |
| 4,862,940 | A | * | 9/1989 | Atchison | 160/67 |
| 5,033,527 | A | * | 7/1991 | Ouvard et al. | 160/68 |
| 5,119,867 | A | * | 6/1992 | Lukos | 160/70 |
| 5,284,198 | A | * | 2/1994 | Kauka | 160/70 |
| 5,291,934 | A | * | 3/1994 | Ouvard et al. | |
| 5,638,884 | A | * | 6/1997 | Lin | 160/265 |

FOREIGN PATENT DOCUMENTS

| | | | | |
|---|---|---|---|---|
| DE | 1683477 | * | 10/1969 | 160/70 |
| DE | 3504502 | * | 8/1986 | 160/67 |
| GB | 212706 | * | 3/1924 | 160/69 |
| GB | 483001 | * | 4/1938 | 160/70 |

* cited by examiner

*Primary Examiner*—Blair M. Johnson
(74) *Attorney, Agent, or Firm*—Arent Fox Kintner Plotkin & Kahn

(57) ABSTRACT

Disclosed is a sunshade roll screen which has light weight, has a sufficient degree of strength, and is quickly responsive to a rush of wind or the like. Gears held in mesh with each other are formed at adjacent ends of two arms coupled in series to construct a collapsible arm link. Meshing portions of a plurality of the collapsible arm links are coupled to each other by a connecting rod. Opposite ends of each of the collapsible arm links are pivoted to a support pipe and a horizontal moving rod to construct a framework. A roll screen is stretched over the framework.

15 Claims, 14 Drawing Sheets

SUNSHADE ROLL SCREEN

BACKGROUND OF THE INVENTION

1. Field of the Invention

The present invention relates to a sunshade roll screen disposed at an outer upper end of a window or opening of buildings or houses, and having functions to not only adjust the intensity of sunlight coming into a room, but also screen the interior of the room from the outside.

2. Description of the Related Art

Heretofore, sunshade roll screens capable of being unrolled from and rolled up into a storage case have been employed instead of pent roofs and stationary tents which are fixedly disposed at outer upper ends of windows or openings of buildings. One of the known sunshade roll screens is constructed below. Both ends of a winding shaft, over which a screen is rolled up from at one end, are attached to a wall surface, and the other end of the screen is fixed to a horizontal moving rod. The horizontal moving rod is supported at its both ends to upper ends of two extensible posts which are attached to the wall surface. The screen is unrolled and rolled up by rotating a speed reducer connected to an end of the winding shaft with a crank handle or an endless cord trained over a pulley of the speed reducer.

As an improvement of the above conventional sunshade roll screen, there is known such a screen (trade name; AWNING) that, instead of the two posts supporting the both ends of the horizontal moving rod, a plurality of collapsible arm links are attached at one ends thereof to a wall surface, the arm links being able to fold from and unfold into a position projecting into midair in a horizontal direction like crab legs, and the horizontal moving rod is attached to the other ends of the arm links. Such an improved sunshade roll screen includes a mechanism of always resiliently urging the collapsible arm links to unfold in a direction toward the linear state. By rotating a speed reducer connected to a winding shaft, over which the screen is rolled up, with a crank handle or an electric motor, the collapsible arm links are unfolded to resiliently urge the horizontal moving rod forward so that the screen spreads.

The conventional sunshade roll screens described above have however problems below. In the former sunshade roll screen having two posts, as the screen spreads, the posts descend while their upper ends are moved along circles. Therefore, when the sunshade roll screen is installed in a place where the spread screen becomes an obstacle to traffic, the length of the posts must be prolonged and this operation is troublesome. Further, the presence of the posts impairs an appearance aesthetically.

On the other hand, the sunshade roll screen (AWNING) having the collapsible arm links has problems below. The collapsible arm link comprises two arms, each in the form of a square pipe, which are joined with each other in a relatively pivotable manner. A coil spring is disposed in the arms and a wire rope or the like is passed through the arms in such a manner that the two arms are resiliently urged to unfold with a strong force in a direction from the collapsed state toward the linear state. The horizontal moving rod supporting the screen is therefore required to have a large sectional area and a high degree of strength so as not to flex into a bowed shape with the resiliently urging force applied from the collapsible arm link, thus resulting in larger dead weight of the horizontal moving rod. Also, the winding shaft holding the screen tightly must be made of a strong hollow shaft having a large outer diameter (usually in the range of 50 to 100 mm) so that the winding shaft will not flex into a bowed shape and the screen will not slack. As a result, the total dead weight of components of the roll screen is increased.

Further, when the collapsible arm link is unfolded solely, the unfolding operation is effected as a link motion. To prevent the horizontal moving rod from wobbling laterally to the left and right, therefore, two or more collapsible arm links are disposed in symmetrical relation like crab legs. With this structure, forces acting on the horizontal moving rod in opposite directions upon the link motions of the collapsible arm links are canceled out, and the horizontal moving rod is allowed to move in parallel relation to the wall surface while it is prevented from wobbling laterally to the left and right. However, because the sunshade roll screen utilizes the resiliently urging forces applied from the collapsible arm links for spreading the screen tightly, the screen can no longer spread evenly and the horizontal moving rod supporting the screen can no longer keep a parallel and horizontal posture with respect to the wall surface, if there occurs uneven expansion and contraction of screen cloth, or if there occurs uneven deterioration in the resiliently urging forces applied from the collapsible arm links. Consequently, when the screen is retracted, the screen is not rolled up over the winding shaft in a perpendicular direction, and the horizontal moving rod moves with one end rising to a higher level and the other end dropping to a lower level. This results in that the screen is not fully rolled up at either end and the horizontal moving rod cannot be completely returned at one end back to a predetermined storage position.

To cope with the above problem, the screen cloth is required to have such a high tensile strength as enough to prevent uneven expansion and contraction of the cloth. Generally, the screen material is a piece of cloth made of chemical fibers such as polyester fibers, and the fibers are impregnated with a coating material having a water repelling property, e.g., a fluorocarbon resin, for the purpose of suppressing expansion and contraction of the fibers. As the cloth fibers are impregnated with a larger amount of the coating material, expansion and contraction of the screen cloth is held down to a lower level. For this reason, a piece of thick cloth impregnated with a large amount of the coating material is generally employed as exterior screen cloth in usual cases. The screen using such cloth has however a disadvantage of having increased dead weight. Spreading the screen with large dead weight over an entire target area without any slack requires that the arms links are resiliently urged with a considerably strong force.

Thus, a considerably large rotating load is required to rotate the large-diameter winding shaft itself, and a driving load necessary for rolling up the screen, which is held in tightly spread state by the arm links under the strong resiliently urging forces, is further increased. Accordingly, a speed reduction ratio of the speed reducer must be set to a considerably large value to make the operating force smaller. This results in a such drawback that when the screen is manually rolled up with a crank handle or the like, the operation requires a long time and is troublesome, and when the screen is rolled up with rotation of a geared motor, the motor is required to have a large torque and a product cost is increased. Another drawback of the latter sunshade roll screen is that in the event the screen in the spread state is blown by a so strong rush of wind as to possibly damage any component of the screen and the wall surface to which the screen is attached, the rolling-up speed is too slow to retract the screen quickly if the screen is manually rolled up. Even if the screen is rolled up by an electrically-powered operation in combination with a wind gauge, the rolling-up speed of the geared motor is also not enough in many cases. In other words, satisfactory effectiveness is not achieved in match with an increase in cost.

As still another drawback, the latter sunshade roll screen is not adaptable for keeping off the low evening sun and the sunlight coming in obliquely with respect to the wall surface. Moreover, the sunshade roll screen (AWNING) having a structure to hold the collapsible arm links projecting into midair has large total weight because of large dead weights of individual components, as mentioned above, and it is fixedly bolted to the outer surface of a heavy-weight wall with a high degree of strength, such as made of iron frames, concrete, or stones. Therefore, work of installing the screen is difficult to implement and necessarily requires skilled workers in an actual situation. If the heavy-weight sunshade roll screen is installed to a light-weight outer wall of wooden houses, the wall surface may be damaged with a overload imposed on the wall surface upon passing of a rush of wind and so forth. Such a screen is hence not suitable for wooden houses. In addition to those various problems, the screen is hard to remove for cleaning. In many cases, the screen is used for a long period of time while being left dirty, which results in an unpleasant appearance from the aesthetic point of view.

SUMMARY OF THE INVENTION

With a view of improving the problems set forth above, an object of the present invention is to provide a light-weight, compact sunshade roll screen which can be installed to any type of wall surfaces with easy mounting work, and which can unroll and roll up a screen speedily with a simple operation. Further, the sunshade roll screen includes a safety device having a sensor which is responsive to even an instantaneous external pressure such as caused by a rush of wind, for example, to retract the screen into a storage state in a moment, has functions of keeping off even the light from the low sun and screening the interior of rooms from the outside, and enables the screen to be simply removed for cleaning with ease.

To that end, according to a sunshade roll screen of the present invention, hinges formed with gears held in mesh with each other are fixed to adjacent ends of two arms coupled in series. A collapsible arm link capable of folding and unfolding is constructed by the two arms through the hinges, the collapsible arm link being arranged two or more in parallel. Each of the collapsible arm links has one end angularly movably pivoted to a support pipe fixedly disposed on the wall side, and the other end angularly movably pivoted to a horizontally moving rod. Further, hinged points of the collapsible arm links are coupled to each other by a connecting rod, and a framework is constructed by the arms, the horizontal moving rod and the support pipe arranged to define quadrilateral in the form of parallelograms. Then, a roll screen capable of being unrolled and rolled up is attached onto the framework.

Also, according to a sunshade roll screen of the present invention, one ends of two arms are angularly movably pivoted in the same plane to a support pipe fixedly disposed on the wall side, and a horizontal moving rod is disposed parallel to the support pipe. Two rack gears are slidably disposed in the horizontal moving rod in an opposed relation, the two rack gears being able to move in opposed directions through an idle gear held in mesh with the two rack gears. Sliding shoes slidable in the horizontal moving rod are connected to ends of the two rack gears, and the other ends of the arms are angularly movably pivoted to the sliding shoes. A roll screen capable of being unrolled and rolled up is attached onto a framework constructed by the arms, the support pipe and the horizontal moving rod.

Moreover, in the above sunshade roll screen, a roll of the screen wound over a winding shaft is accommodated in a storage case having a slit, and has an outer periphery supported by a slit-side inner wall surface of the storage case. Additionally, when the screen swing with respect to the support pipe upon receiving an excessively strong external force, the collapsible arm links are folded automatically, or the screen is rolled up automatically.

With the sunshade roll screen of the present invention constructed as set forth above, the roll screen can be easily spread to a predetermined position by pulling down an operating with no need of lateral posts. Also, the collapsible arm links enable the horizontal moving rod to translate evenly through the connecting rods and the hinges. The weight of the roll screen and the winding shaft can be lessened, and the strength required for the support components can be reduced. Further, the roll screen can be rolled up automatically because a trigger is released from its locked state when the screen is blown by a rush of wind or the like. In addition, the roll screen is easily replaceable.

DESCRIPTION OF THE PREFERRED EMBODIMENTS

Figure 1:
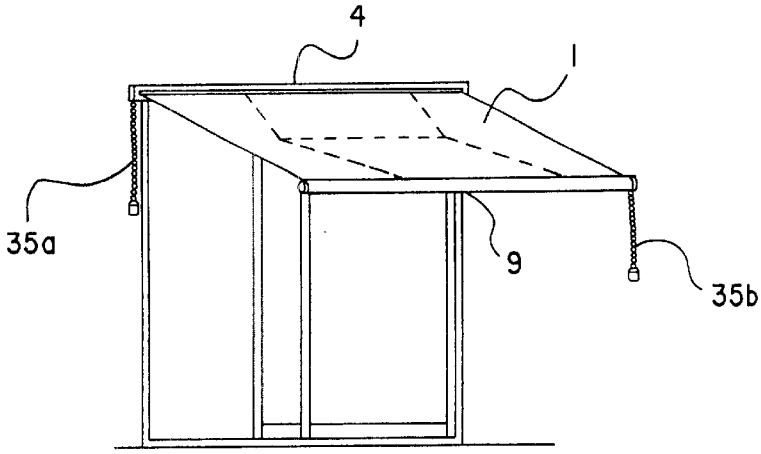
FIG. 1 is a perspective view showing a state where a sunshade roll screen according to the present invention is stretched substantially in a plane.
Figure 2:
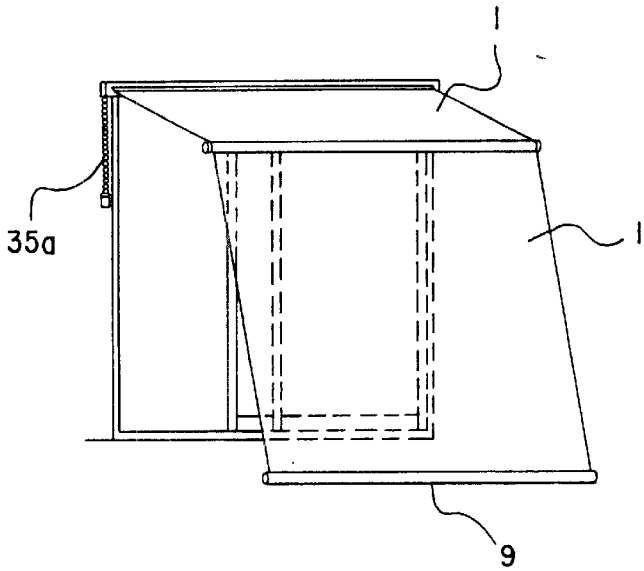
FIG. 2 is a perspective view showing a state where the sunshade roll screen according to the present invention is stretched downward from a horizontal moving rod locating midway.
Figure 3:
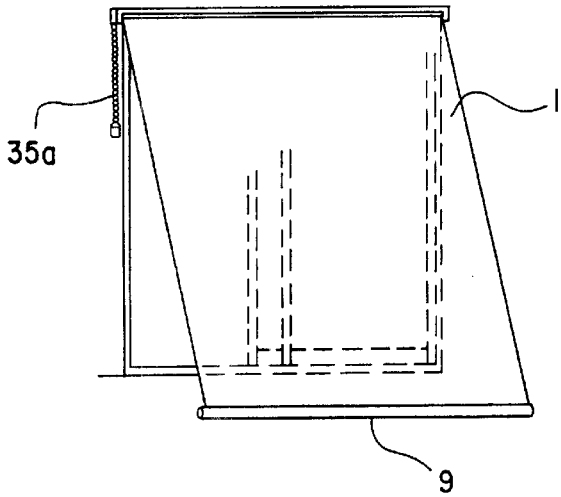
FIG. 3 is a perspective view showing a state where a sunshade roll screen according to the present invention is stretched obliquely.
Figure 4:
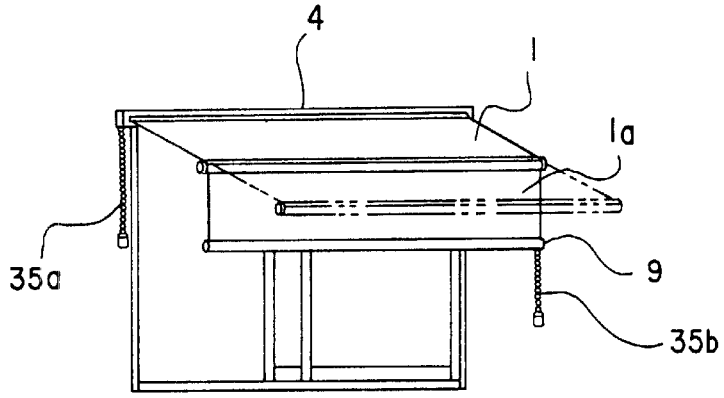
FIG. 4 is a perspective view showing a state where the sunshade roll screen according to the present invention is extended downward vertically from the horizontal moving rod locating midway.
Figure 5:
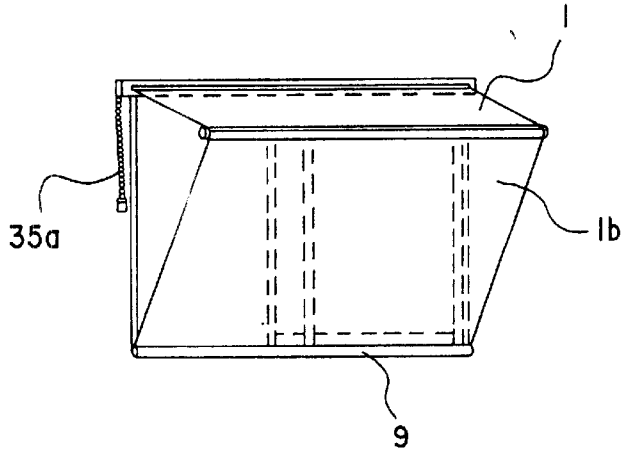
FIG. 5 is a perspective view showing a state where the sunshade roll screen according to the present invention is stretched downward from the horizontal moving rod locating midway and latched to a window frame.
Figure 6:
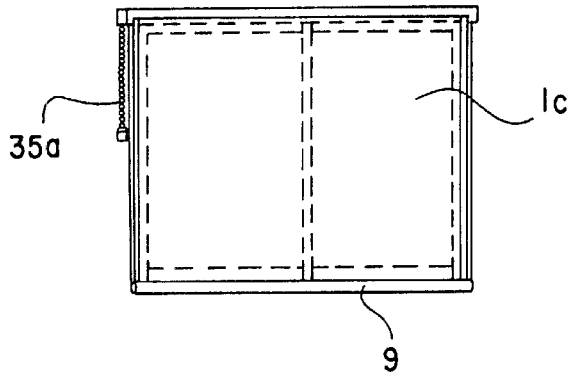
FIG. 6 is a perspective view showing a state where the sunshade roll screen according to the present invention is extended downward vertically and latched at its lower end.

FIGS. 1 to 6 are perspective views showing appearances of a sunshade roller screen according to the present invention in various forms. FIGS. 1, 2 and 3 illustrate the sunshade roller screen disposed above a terrace window having a large opening height, while FIGS. 4, 5 and 6 illustrate the sunshade roller screen disposed above a window having a relatively small opening height. In these figures, numeral (1) denotes a sunshade roller screen according to the present invention.

Figure 7:
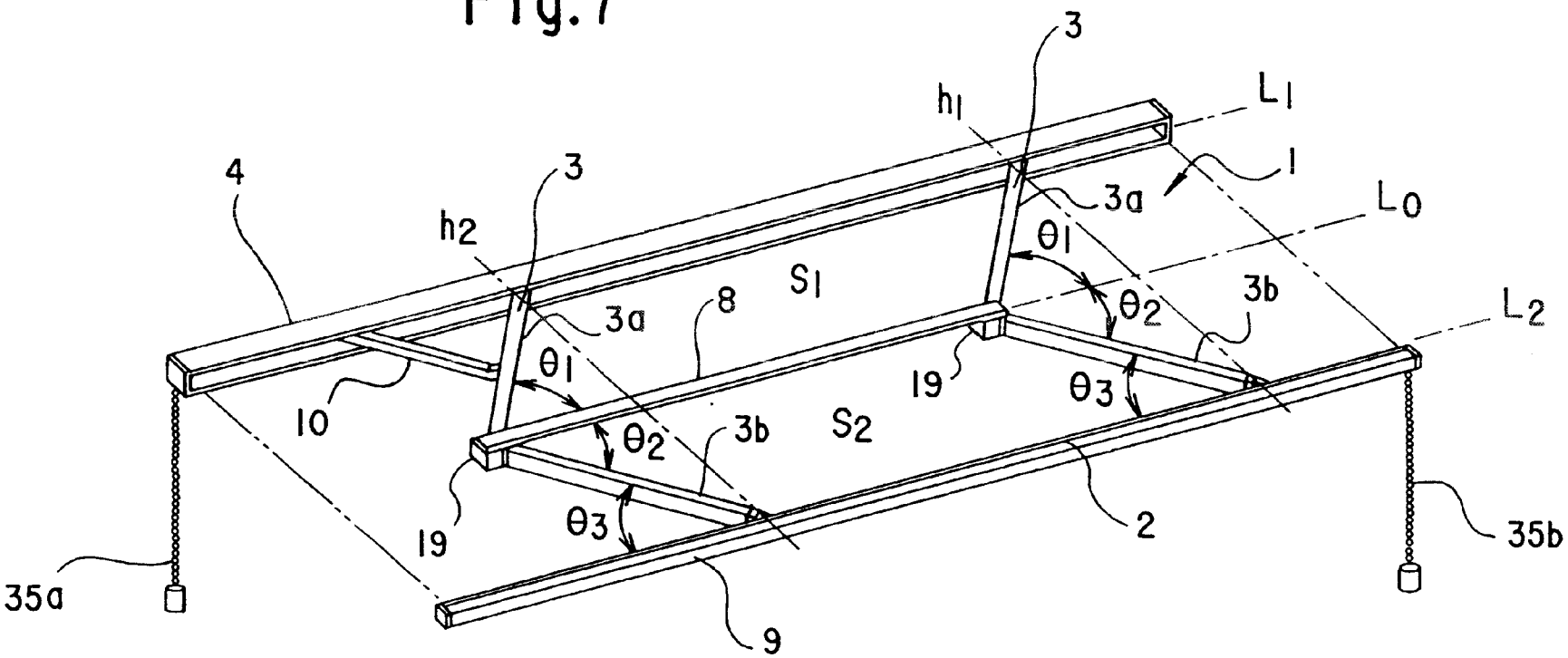
FIG. 7 is a perspective view showing a construction of the roll screen including collapsible arm links according to a first embodiment of the present invention.

An appearance perspective view of FIG. 7 shows a construction of the sunshade roller screen according to a first embodiment of the present invention, the screen being disposed above a terrace window of a house as shown in FIG. 1. Referring to FIG. 7, the sunshade roller screen comprises the screen (1), a horizontal moving rod (2), and two or more collapsible arm links (3) capable of folding and unfolding. Each of the collapsible arm links (3) has one end angularly movably pivoted to the side of a box case (4) which is fixed to a wall surface, and the other end angularly movably pivoted to the horizontal moving rod (2). The screen (1) has one end fixed to a winding shaft, described later, housed in a storage case (9) which is engaged with the horizontal moving rod (2), and the other end fixed to the box case (4).

The collapsible arm links (3) each comprise two arms **(3*a*) and (3*b*) coupled with each other in series. As described later, gears are secured to adjacent ends of the arms (3*a*) and (3*b*) and are held in mesh with each other. Through the meshing gears, when one arm (3*a*) rotates, the other arm (3*a*) is also rotated so that angles $\theta_1$ and $\theta_2$ formed by the arms (3*a*) and (3*a*) with respect to a horizontal line $L_0$ (FIG. 7), respectively, are always kept at the same value. Since joint points (19) of the two collapsible arm links (3) are coupled to each other, a quadrilateral $S_1$ surrounded by the collapsible arm links (3), the connecting rod (8) and a horizontal line $L_1$ connecting the points at which the collapsible arm links (3) are pivoted to the side of the box case (4), and a quadrilateral $S_2$ surrounded by the collapsible arm links (3), the connecting rod (8) and the horizontal moving rod (2) are defined as parallelograms which are identical in shape and symmetrical with respect to the horizontal line $L_0$. Then, the horizontal lines $L_0$, $L_1$ and $L_2$ are always kept in parallel relation. In addition, since the horizontal line $L_2$, i.e., the horizontal moving rod (2), is moved in a direction perpendicular to the horizontal line $L_1$ without wobbling laterally to the left and right, it is ensured that even when the horizontal moving rod (2)** is pulled or pushed at any point, it can move in parallel relation to the horizontal line $L_1$ without wobbling laterally to the left and right.

Accordingly, the screen (1) is evenly unrolled from and rolled up into the storage case (9) housing a hollow winding shaft (55) in which a torsion spring (described later) is incorporated. To stop the spread screen (1) from being retracted with a resiliently urging force of the torsion spring, one of the collapsible arm links (3) is checked from rotating backward. For this purpose, there is provided a sub-link (10) which has one end rotatably pivoted to the arm **(3*a*) of the one collapsible arm link (3), and the other end engaged with the side of the box case (4) in a rotatably and slidable manner. Further, when the one end of the sub-link (10) slides until a predetermined position, the sub-link (10) is latched by a retractable trigger (described later) and is restrained from moving back as with ribs of a umbrella automatically opened. Accordingly, the collapsible arm links (3) are also restrained from rotating backward, and the screen (1) is prevented from being rolled back. To release the screen from the restrained state, an operating cord (35*a*) hanging from one end of the box case along the wall surface is pulled downward, whereby the one end of the sub-link (10) pivoted to the side of the box case (4) is released from the state restrained from sliding. Upon the release of the sub-link (10), the horizontally moving rod (2) is pulled back through the screen under the action of the torsion spring, and at the same time the collapsible arm links (3) are folded and then housed into the box case (4)**.

On the other hand, when the screen (1) is spread at a larger inclination angle with respect to the horizontal line, not only a vertically downward component of the dead weight of both the horizontally moving rod (2) and the storage case (9) supported by the collapsible arm links (3), but also a vertically downward component of the dead weight of the collapsible arm links (3) are increased, and so does a load required for rolling back the screen (1) correspondingly. By setting the dead weight (load), due to gravity, of those components to be balanced by the pulling-back force of the torsion spring at a predetermined position, the screen (1) is kept stand still there without being retracted. For rolling up the screen (1) into the stored state, the horizontally moving rod (2) is just required to be pushed back to such an extent as giving acceleration to the horizontally moving rod (2), whereupon the horizontally moving rod (2) is raised while the collapsible arm links (3) are folded. At the same time, the screen (1) is rolled up over the winding shaft (55) in a similar manner to ordinary winding shutters.

Figure 8:
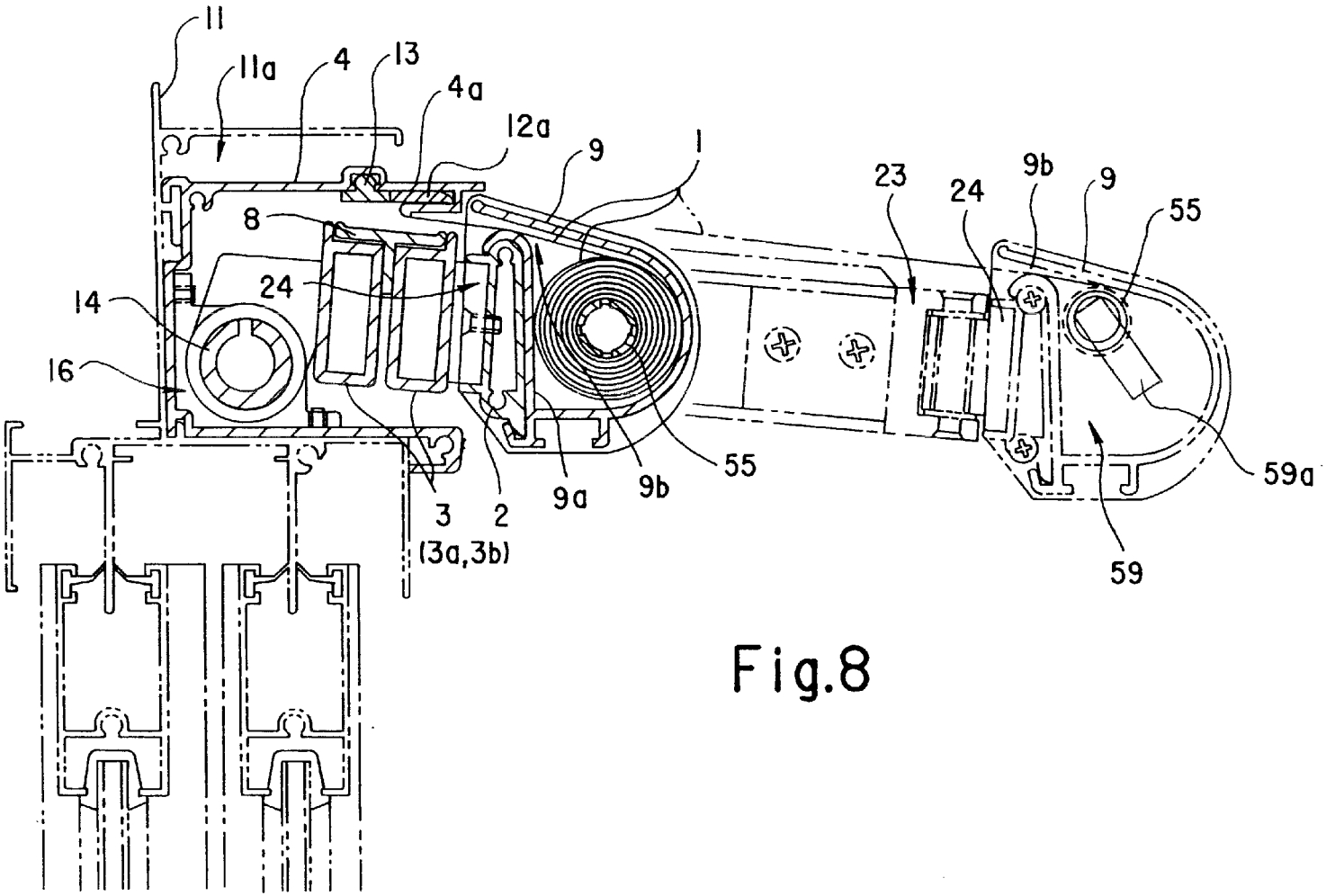
FIG. 8 is a side sectional view of the roll screen shown in FIG. 7.

FIG. 8 is a sectional view showing a state where a unit of the sunshade roll screen according to the present invention is installed in a storage pocket **(11*a*) which is provided beforehand on an upper frame (11) of an aluminum sash. The sunshade roll screen unit can be compactly housed in the box case (4), is attached into the storage pocket (11*a*) in a detachable manner, and has light weight for easier maintenance. The collapsible arm links (3) and the horizontally moving rod (2) are constructed as described above. Numeral (9) denotes a storage case in which the winding shaft (55) is incorporated. A leading end of the screen (1) rolled up over the winding shaft (55) is bonded to a flat bar (12*a*), is pushed into a slit (4*a*) formed in an upper wall of the box case (4), and is retained in place by a packing (13) so as not to slip off from there. Numeral (14) denotes a hollow support pipe fixedly supporting hinges (22) secured to the arms (3*a*) of the collapsible arm links (3). The support pipe (14) is supported by a holder (16) which is fixed to the box case (4)**.

Hinges (24) are fixedly disposed on the horizontally moving rod (2) engaged with the storage case (9) in a detachable manner, and are angularly movably jointed to hinges (23) attached to ends of the arms (3*a*) through pivots (20). As will be seen from the above description, including FIG. 1, when the horizontally moving rod (2) or the storage case (9) is pulled out forward, the screen (1) is unrolled to spread while the winding shaft (55) rotates with a pulling force applied from the screen (1). With the rotation of the winding shaft (55), the urging force of the torsion spring (described later) is increased and an outer diameter of the rolled-up screen decreases. Simultaneously, the winding shaft (55) moves toward an exit slit (9*b*) while an outer periphery of the screen roll over the winding shaft (55) is kept supported over its entire length by an inner wall surface (9*a*) of the storage case (9). During the movement of the winding shaft (55), as described later, a terminal of the torsion spring is guided along a slot formed in a movement bearing which is fixedly disposed at an end of the storage case (9).

Figure 9:
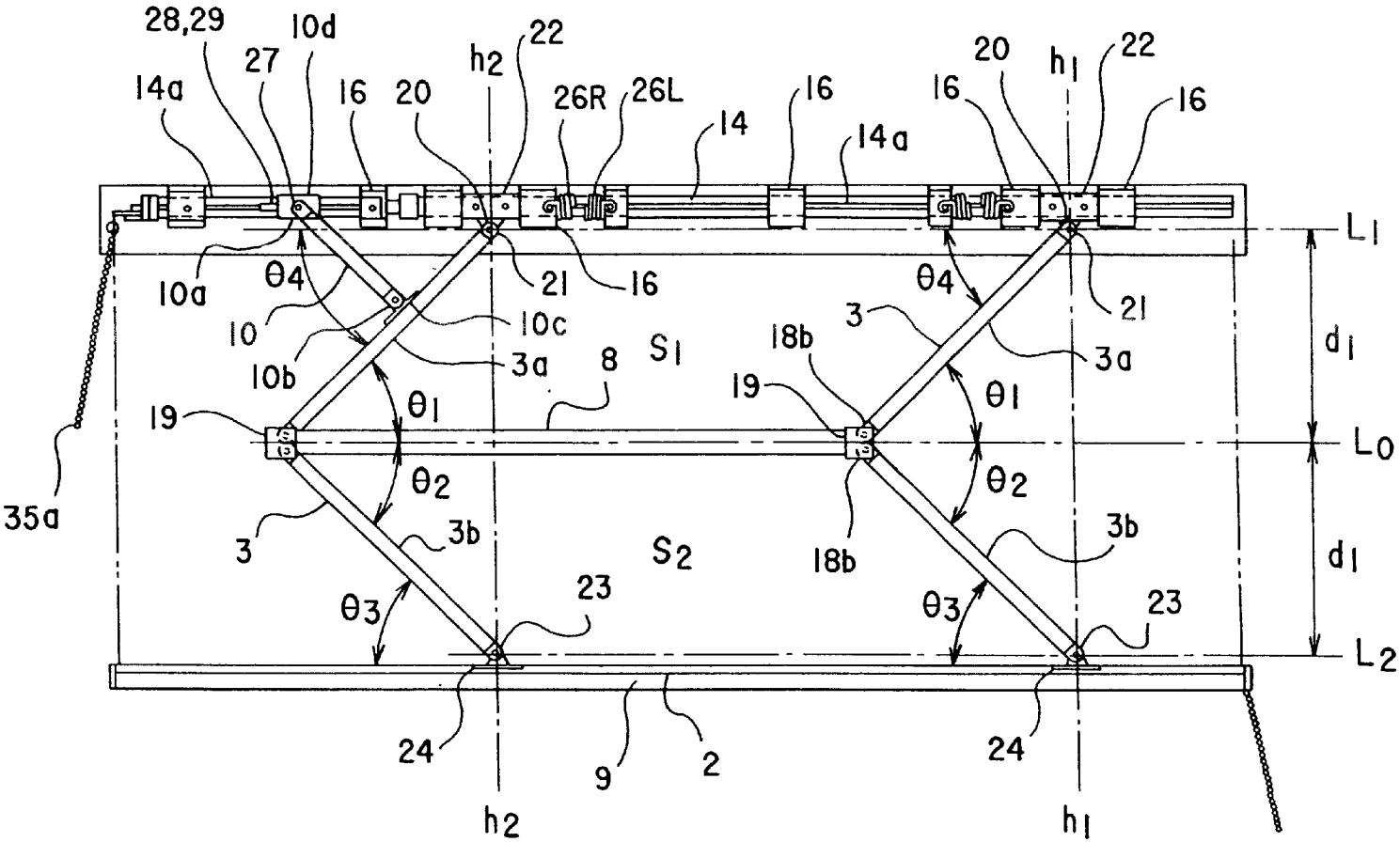
FIG. 9 is a plan view of the roll screen shown in FIG. 7.
Figure 10:
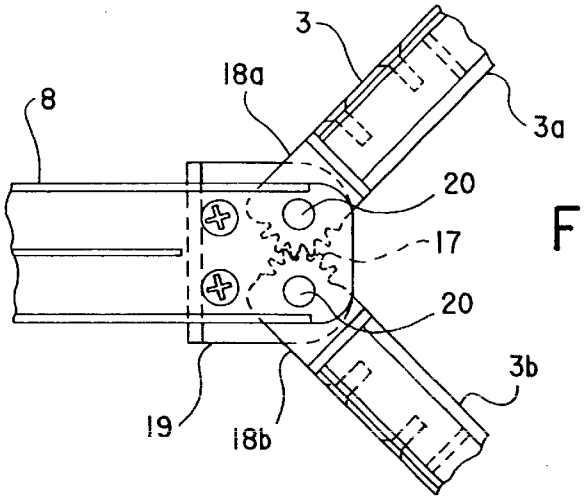
FIG. 10 is an enlarged view of a hinge portion shown in FIG. 9.

FIG. 9 is a plan view showing a framework of the sunshade roll screen according to the first embodiment of the present invention. The collapsible arm links (3) are disposed in appropriate number depending on the width of an opening or window to which the screen is attached, but the following description will be made on the case of disposing two collapsible arm links (3). Each of the collapsible arm links (3) comprises two arms (3*a*) and (3*a*) each in the form of a square pipe. Hinges (18*a*) and (18*b*) provided with gears (17) are fixed to one ends of the arms (3*a*) and (3*a*) which are interconnected in a pivotable manner (FIG. 10), the gears (17) of the hinges (18*a*) and (18*b*) being held in mesh with each other. The hinges (18*a*) and (18*b*) are angularly movably attached through pivots (20) to a hinge (19) which is substantially channel (C)-shaped in section. Also, hinges (21) and (23) are fixed respectively to the other ends of the arms (3*a*) and (3*b*). The hinge (21) of the arm (3*b*) is angularly movably attached through a pivot (20) to the hinge (22) fixed to the support pipe (14). The hinge (23) of the arm (3*a*) is angularly movably attached through a pivot (20) to the hinge (24) fixed to the horizontally moving rod (2). The horizontally moving rod (2) is thus supported in a horizontal position by the two arms (3*b*).

The connecting rod (8) is fixedly provided between the apexes of the two collapsible arm links (3) in the angled form, i.e., between the two hinges (19), whereby the distance between the two hinges (19) is always held constant. Likewise, the distance between the two hinges (22) on the support pipe (14) side and the distance between the two hinges (22) on the horizontally moving rod (2) side are also fixed to the same length. Here, the collapsible arm links (3) and the horizontally moving rod (2) operate as described above with reference to FIG. 7. Additionally, the hinges (22) pivotably supporting the arm (3*a*) are fixedly attached to the support pipe (14) to be kept from rotating idly, and the support pipe (14) is rotatably held by the holder (16). The support pipe (14) is restrained by coiled springs ($\mathbf{26}_R$) and ($\mathbf{26}_L$), described later, from rotating forward and backward. Specifically, in the above structure, the coiled springs ($\mathbf{26}_R$) and ($\mathbf{26}_L$) are set so that when the collapsible arm links (3) are unfolded to a predetermined position and the screen (1) is in a fully spread state, the moment of rotation transmitted from the arms (3*a*) to the support pipe (14) is balanced by equal strong torsional forces developed by the coiled springs ($\mathbf{26}_R$) and ($\mathbf{26}_L$), and the arms (3*a*) are held at,a predetermined inclination angle (5 to 10°).

Figure 11:
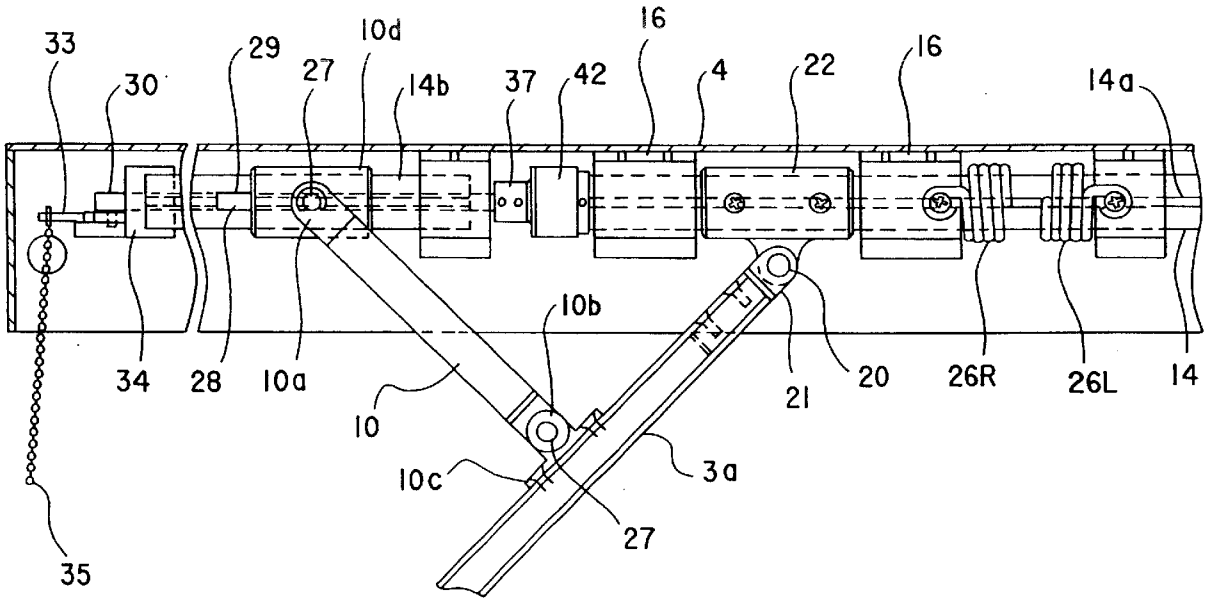
FIG. 11 is a partial enlarged view showing joint between a support pipe and the collapsible arm link shown in FIG. 9.

Numeral (10) denotes a sub-link, described above with reference to FIG. 7, of which both ends are angularly movably attached to the arm (3*a*) and the support pipe (14) for link motion, respectively. Referring to FIGS. 9 and 11, the hinge (22) pivotably supporting the arm (3*a*) is fitted over the support pipe (14) and is fixed to be kept from rotating idly. Numeral (16) denotes a holder which is fixed to the box case (4) and rotatably supports the support pipe (14). Numerals ($\mathbf{26}_R$) and ($\mathbf{26}_L$) denote right-hand and left-hand coiled springs, respectively, which have one ends latched to the slit (14*a*) formed in the support pipe (14) and the other ends fixed to the holder (16). The coiled spring ($\mathbf{26}_R$) is set to develop such a degree of spring strength that when the arms (3*a*) is unfolded to a predetermined maximum angle, the large torsional moment transmitted from the arms (3*a*) to the support pipe (14) is balanced and the collapsible arm link (3) can be kept standstill at a preset downward inclination angle (usually 5 to 10°). If an external pressure such as a wind pressure is further applied to the collapsible arm link (3), the coiled spring ($\mathbf{26}_R$) serves also as a shock absorber to absorb a resulting overload. Accordingly, even if the collapsible arm link (3) is momentarily turned to some extent, the coiled spring ($\mathbf{26}_R$) acts to rotate the collapsible arm link (3) to the original inclination angle. The other coiled spring ($\mathbf{26}_L$) is coiled in a direction opposed to the coiled spring ($\mathbf{26}_R$), and hence acts to absorb a shock caused when the collapsible arm link (3) undergoes a wind pressure tending to turn it upward.

Figure 12:
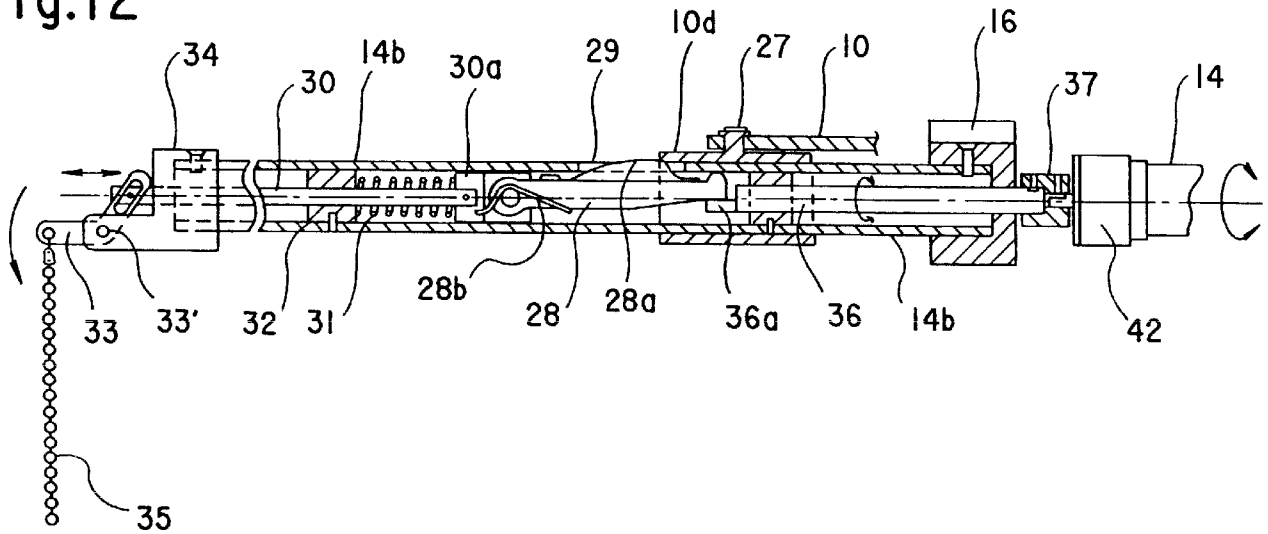
FIG. 12 is a longitudinal side sectional view of the portion shown in FIG. 11.

Hinges (10*a*) and (10*b*) are fixed to both ends of the sub-link (10). One end of the sub-link (10) is angularly movably attached through a pivot (27) to the hinge ($\mathbf{10}_c$) fixed to the collapsible arm link (3), and the other end thereof is angularly movably attached through a pivot (27) to the hinge (10*d*) fitted over a support pipe (14*b*). When the collapsible arm link (3) is turned, the sub-link (10) is also moved through link motion, causing the hinge (10*d*) to slide to the left and right along the support pipe (14*b*). The support pipe (14*b*) is formed with a slot (29) which allows a trigger (28) including a leaf spring (28*a*) to protrude and retract through it. The trigger (28) is fixed to a terminal (30*a*) of a rod (30), and is forced to retract into the slot (29) when the rod (30) is pulled back to the left. A stationary ring (32) is fixed to the support pipe (14*b*) and a compression spring (31) is inserted in the stationary ring (32) to resiliently urge the rod terminal (30*a*) so that the trigger (28) is always kept protruded from the slot (29) (FIG. 12).

The other end of the rod (30) projects out of an end of the support pipe (14*b*) and engages with a crank (33). The crank (33) is angularly movably pivoted to a bracket (34) which is fixedly disposed at the end of the support pipe (14*b*). The operating cord (35*a*) such as a ball chain hangs downward from the other end of the crank (33). Further, the trigger (28) is pivoted to the rod terminal (30*a*) and is always resiliently urged by a coiled spring (28*b*) so as to protrude from the slot (29). Accordingly, in the closed position the rod terminal (30*a*) moves to the right direction in FIG. 12 receiving the urging force of the compression spring (31). At this time a fore end (28*c*) of the trigger (28) is engaged with the lever (36*a*) from the upper side so that the trigger is restrained from going down into the slot (29). In this closed position, when the operating cord (35*a*) is pulled downwardly the rod (30) moves to the left side against the urging force of the compression spring (31), then the trigger (28) pivoted to the rod terminal (30*a*), too, is pulled in to the left side in FIG. 12, thereby disengaging the fore end (28*c*) of the trigger from the lever (36*a*). In this state when the horizontally moving rod (2) is forcibly moved in the open direction, the hinge (10*d*) slides along the support pipe (14*b*) (to the right in the figure). As soon as the hinge (10*d*) passes over the trigger (28) which is protruding from the slot (29) in the support pipe (14*b*) as mentioned above, after pressing the trigger (28) down into the slot (29), the trigger (28) is allowed to protrude again, whereby the hinge (10*d*) is restrained from moving back by the presence of the trigger (28).

In other words, at the moment when the horizontally moving rod (2) is pulled out forward and the screen (2) is spread to a predetermined width, the collapsible arm link (3) is checked from rotating backward and therefore the screen is kept standstill in a spread state.

In that condition, since the screen (2) is spread tightly by the resiliently urging force of the torsion spring incorporated in the winding shaft (55) and the horizontally moving rod (2) is also pulled in a direction to fold, the hinge (10*d*) is pushed to the left by the collapsible arm link (3) and the sub-link (10). By pulling down the operating cord (35*a*), therefore, the crank (33) is rotated and the rod (30) is pulled to the left, whereupon the trigger (28) slides and retracts while contacting an edge of the slot (29), thus releasing the hinge (10*d*) from a locked state. Accordingly, the sub-link (10) is folded through link motion and the collapsible arm link (3) is also turned to fold so that the screen (1) is rolled up into the storage case with rising of the horizontally moving rod (2). On the other hand, if the horizontally moving rod (2) is pushed up (or pulled down) with a relatively strong force when the screen (1) is kept standstill in the spread state, the hinge (10*d*) is forced to pass over the leaf spring (28*a*) while pushing it down to a flat position by a tapered portion of the hinge. Thus, the screen (1) can also be rolled up without pulling down the operating cord (35*a*).

Figure 13:
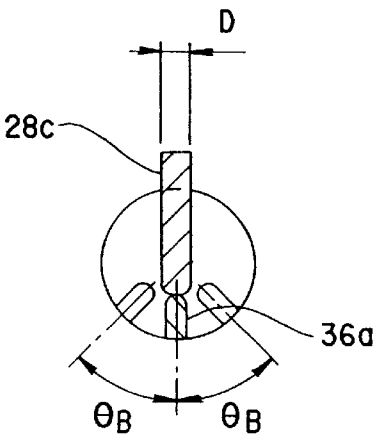
FIG. 13 is an partial enlarged transverse sectional view of the portion shown in FIG. 12.

Next, a mechanism for retracting the screen through release of the sub-link (10) from the link-motion restrained state upon the component receiving an overload, when the screen in the spread state is blown by a rush of wind, will be described below. In FIG. 12, a fore end (28*c*) of the trigger (28) contacts at its lower surface with a lever (36*a*) to be restrained from rotating (FIG. 13). Usually, upon the operating cord (35*a*) being pulled down, the trigger (28) is forced to slide horizontally while engaging with the lever (36*a*) in a disengageable manner. The lever (36*a*) is provided by integral molding at a fore end of a drive shaft (36) in its outer peripheral portion, which is incorporated and supported rotatably in the support pipe (14*b*). When the drive shaft (36) is rotated through a predetermined angle $\theta_B$, the lever (36*a*) is disengaged from the trigger end (28*c*) and the trigger (28) is released from the state restrained from rotating (FIG. 13). By setting the resilient force of the coiled spring (28*b*) supporting the trigger (28) upward, while resiliently urging it, to such an extent that the hinge (10*d*) cannot be restrained from sliding by the resilient force of the coiled spring (28*b*) alone, the hinge (10*d*) is forced to slide while pushing down the trigger (28), allowing the sub-link (10) to move through link motion. The other end of the drive shaft (36) is journaled by the holder (16) fixedly supporting the support pipe (14*b*), and is connected to one side of a shaft coupling (37).

Figure 14:
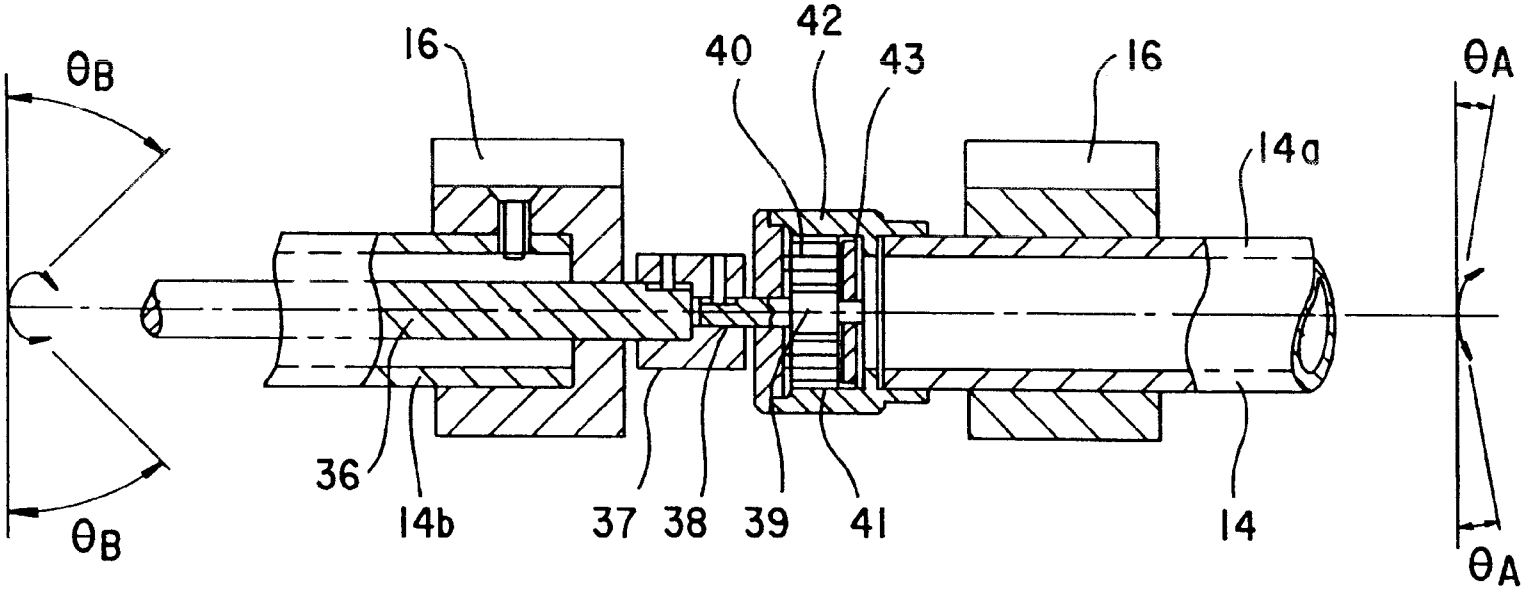
FIG. 14 is a partial enlarged view of a speed reducer shown in FIG. 11.

In an enlarged sectional view of FIG. 14, a drive shaft (38) extending from a speed-up unit (speed reducer) (42) is connected to the other side of the shaft coupling (37) for direct coupling to the drive shaft (36). The speed-up unit (42) is fixed to an end of the support pipe (14) rotatably supported by the holder (16). The speed-up unit (42) comprises a conventional speed reducer although the input and output sides are reversed to the case of the speed reducer. The moment transmitted to the support pipe (14) from the collapsible arm links (3) is strong, but an angle of rotation of the support pipe (14) is very small. This small angle of rotation of the support pipe (14) is not enough to provide the above-mentioned angle $\theta_B$, shown in FIG. 13, at which the lever (36*a*) can disengage from the trigger end (28*c*). For this reason, an internal gear (41) is formed at an inner periphery of the speed-up unit (42), and a planetary gear (40) and a sun gear (39) are rotatably supported by a turning plate (43). These gears (41), (39) and (40) are meshed with each other in such a manner that a small angle $\theta_A$ of rotation of the internal gear (41) and the strong moment of rotation of the support pipe (14) results in large angle $\theta_B$ transmitted to the drive shafts (38) and (36). Because such a planetary gear mechanism does not require high-speed rotation, the angular movement of the internal gear (41) and hence the support pipe (14), that has the large moment of rotation, but is very small, can be efficiently transmitted to the drive shafts (38) and (36) by setting backlashes between the meshing gears to be zero or small as close to zero as possible. Incidentally, since a gear ratio and a width (D) of the trigger end (28*c*) can be set beforehand from experimental values so as to ensure that an angle through which the support pipe (14) and the speed-up unit (42) are forced to turn under a wind pressure in an ordinary condition is less than the angle $\theta_B$ shown in FIG. 14, it is possible to prevent the lever (36*a*) from disengaging from the trigger end (28*c*) unless the occasion requires.

As described above, when an accidental overload caused by a rush of wind, for example, acts on the screen in the spread state, the trigger is released from the engaged state under which the collapsible arm link (3) is checked from turning to fold, and the screen is retracted in a moment by the resiliently urging force of the torsion spring to a fully closed position or a safety position. In addition, such a mechanism can be achieved with a simple structure, thus resulting in a reduced cost.

Figure 15:
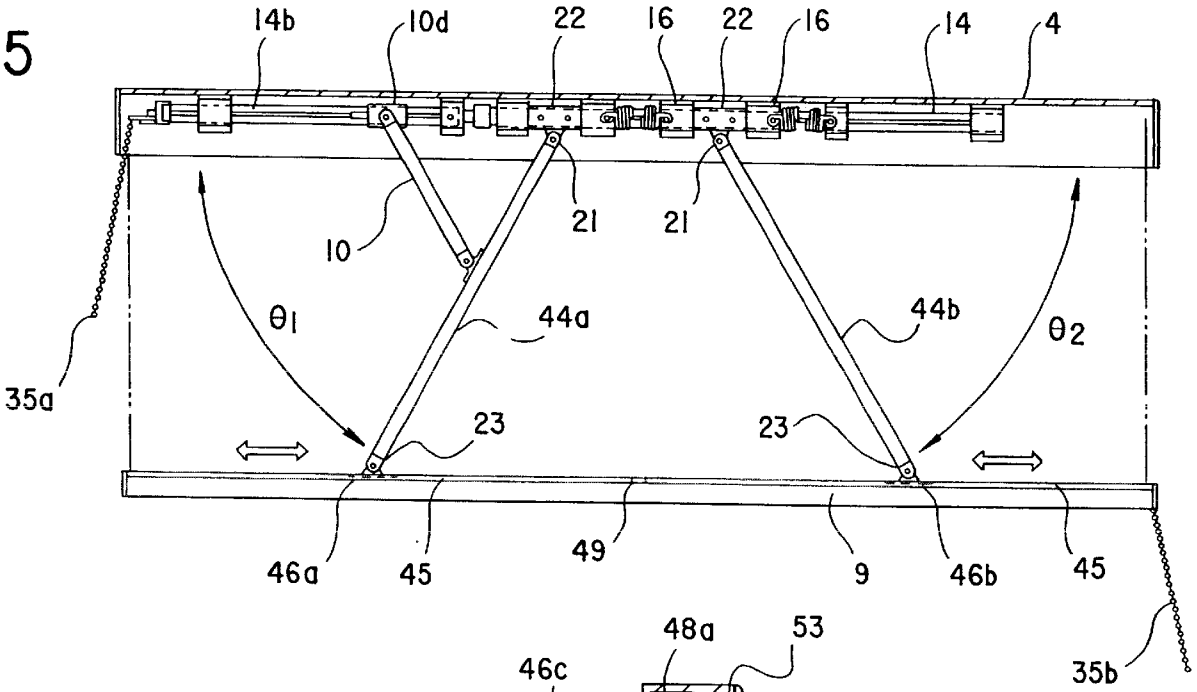
FIG. 15 is a plan view showing a construction of collapsible arm links according to a second embodiment of the present invention.
Figure 16:
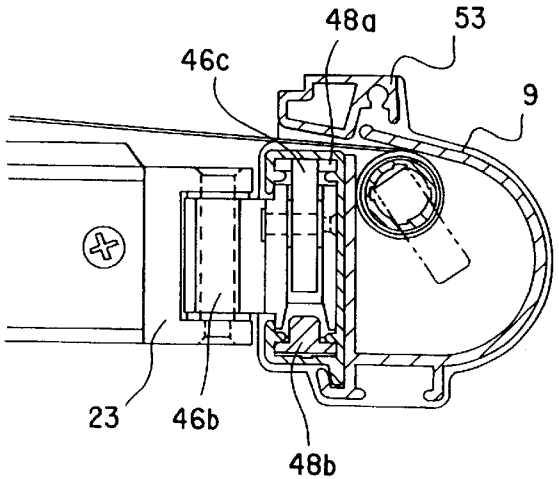
FIG. 16 is a vertical sectional view of a storage case shown in FIG. 15.
Figure 17:
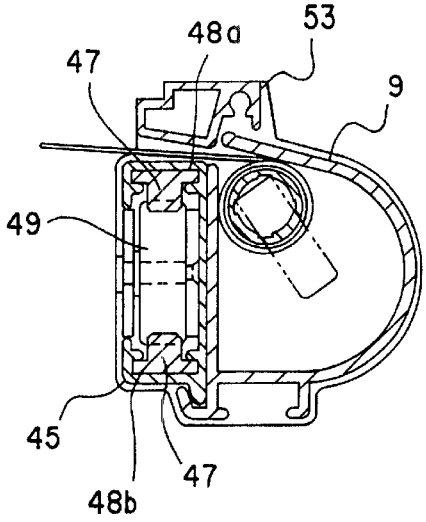
FIG. 17 is, similarly to FIG. 16, a vertical sectional view of the storage case shown in FIG. 15.

FIG. 15 shows a separate-arm structure according to a second embodiment which differs from that of the collapsible arm links according to the first embodiment. FIGS. 16 and 17 are enlarged sectional views of a part of the structure shown in FIG. 15. While the collapsible arm links according to the first embodiment each comprise two links pivotably interconnected in such a manner as being able to fold and unfold, an arm link (44) in the second embodiment comprises one link and is disposed in plural number. Separate arms (44*a*) and (44*b*) are disposed in a symmetrical relation to form two lateral sides of an isosceles trapezoid or an inverted isosceles trapezoid. Ends of the arms (44*a*) and (44*b*) are pivoted to the support pipe (14), and other ends thereof are pivoted respectively to sliding shoes (46*a*) and (46*b*) slidably fitted over a horizontally moving rod (45). With this structure, the horizontally moving rod (45) is supported in a parallel relation to the support pipe (14) such that it can move toward and away from the support pipe (14) while being restrained from wobbling laterally. More specifically, guide channels (48*a*) and (48*b*) for guiding two rack gears (47) are disposed in the horizontally moving rod (45) in an opposed relation, and an idle gear (49) meshing with the rack gears (47) is rotatably disposed at the center of the horizontally moving rod (45). The two rack gears (47) meshing with the idle gear (49) are disposed such that they are driven to move in opposite directions along the guide channels (48*a*), (48*b*) while being kept from flexing (FIG. 17). Accordingly, when a right end of the horizontally moving rod (45), as viewed in FIG. 15, is pushed in a direction to close the screen, the sliding shoe (46*b*) is guided to move to the right. One rack gear (47) connected to the sliding shoe (46*b*) is thereby slid to the right, whereupon the idle gear (49) is rotated. With the rotation of the idle gear (49), the other rack gear (47) opposing to the one rack gear (47) is forced to slide to the left. Therefore, the sliding shoe (46*a*) connected to the other rack gear (47) is slid to the left, thus turning the arm (44*a*) in a direction opposed to the arm (44*b*). Conversely, when the horizontally moving rod (45) is pulled in a direction to spread the screen (1), the arm (44*a*) and (44*b*) are turned in direction approaching each other in a manner reversed to the above case.

By previously setting the arm (44*a*) and (44*b*) to have the same length and to be pivoted to the horizontally moving rod (45) and the support pipe (14) to form angles $\theta_1=\theta_2$, the relationship of $\theta_1=\theta_2$is essentially maintained although there is some deformation due to backlashes between the rack gears (47) and the idle gear (49) meshing with each other. This ensures such an operating effect that the horizontally moving rod (45) is always held in parallel relation to the support pipe (14) and moved in a direction perpendicular to the support pipe (14). Additionally, to reduce sliding frictional resistance, wheels (46*c*) are pivoted to the sliding shoes (46*a*) and (46*b*) as shown in FIG. 16. While the second embodiment includes one idle gear (49), movement of the horizontally moving rod (45) can be transmitted more efficiently by arranging a plurality of idle gears because plays or clearances due to backlashes between the meshing gears are eliminated.

As described above, the conventional screen is structured to operatively couple the winding shaft of the screen to the speed reducer and to spread and retract the screen by rotating the speed reducer manually or with a geared motor, whereas the screen of the present invention is structured to spread and retract the screen by moving the horizontally moving rod and utilizing the resiliently urging force of the torsion spring incorporated in the winding shaft. Accordingly, the screen of the present invention is advantageous in speeding up the operation to spread and retract the screen. Of course, instead of the operation of pushing or pulling the horizontally moving rod, the screen can also be spread and retracted by adding a driving unit for transmitting a force to the arm link or the arm, and operating the driving unit with a crank handle, or an endless cord trained over a pulley, or an electric motor.

Figure 18:
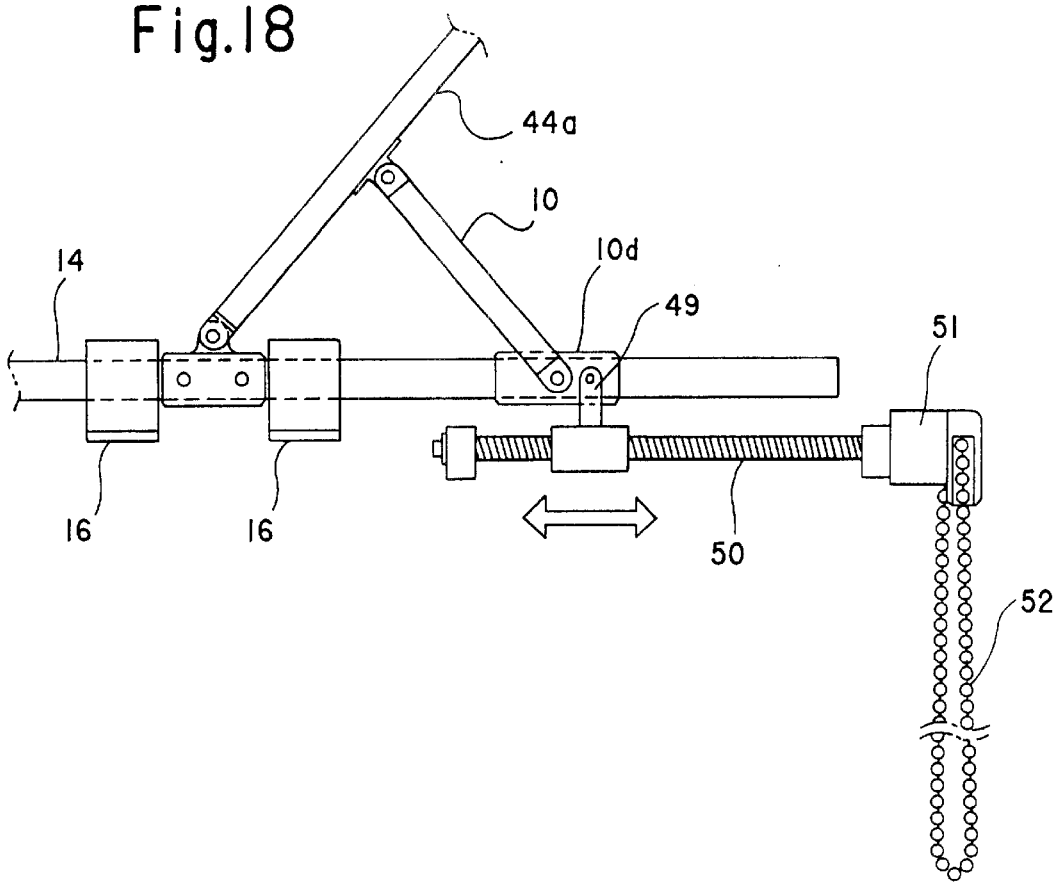
FIG. 18 is a plan view showing joint between the arm link and a sub-link shown in FIG. 15.

FIG. 18 shows one example of such a modification. The sub-link (10) pivoted to the arm (44*a*) is pivotably supported by a hinge (10*d*) fitted over the support pipe (14*b*), and a sliding shoe (49) is detachably engaged with the hinge (10*d*) for moving it together. The sliding shoe (49) is constructed as a well-known ball screw feeding unit wherein small balls are fitted in a groove of a screw (50) and the sliding shoe (49) is moved with rotation of the screw (50). The screw (50) is journaled by a bearing fixed to a pulley case (51).

An endless ball chain (52) is trained over a pulley in the pulley case (51). When the screw (50) is driven to rotate by operating the ball chain (52), the sliding shoe (49) forces the hinge (lod) to move together, thus causing the sub-link (10) to turn. Accordingly, for example, the arm (44*b*) is unfolded to move the horizontally moving rod (45) forward, whereupon the screen (1) spreads. It is needless to say that the screw (50) can be rotated by electric-powered operation by replacing the pulley box with a geared motor.

Figure 19:
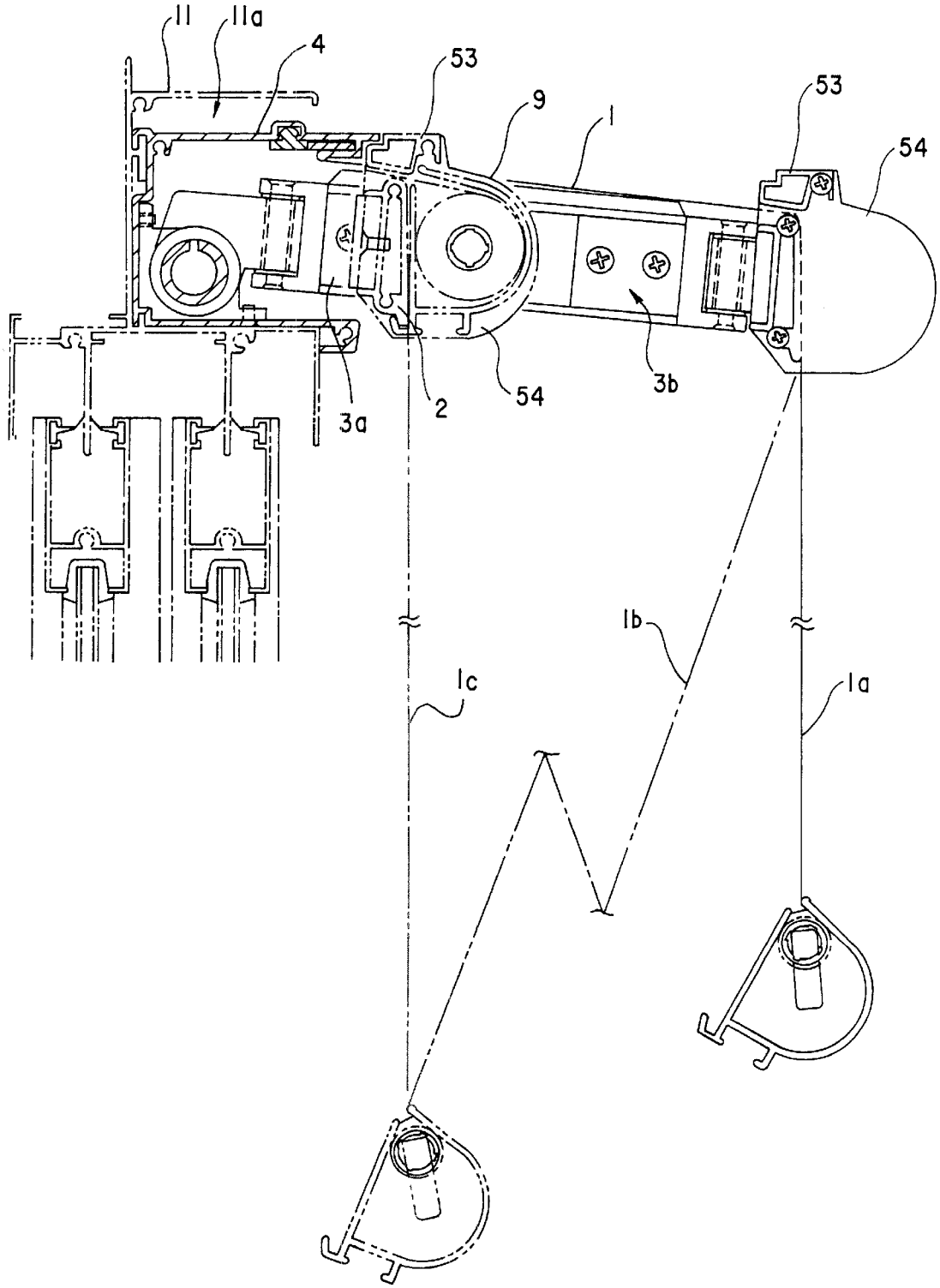
FIG. 19 is a detailed sectional view showing the states shown in FIGS. 4 to 6.

FIG. 19 is a detailed sectional view of the sunshade roll screen corresponding to the appearances shown in FIGS. 4, 5 and 6. Even when the screen (1) is spread obliquely downward from a horizontal line with unfolding of the collapsible arm links, the screen (1) cannot shield the light coming in obliquely from the low sun and the illumination light toward the wall surface in many cases. To cope with such a situation, in FIG. 4, the storage case (9) is pulled downward before spreading the screen (1) in the horizontal direction, and the horizontally moving rod (2) is then pulled forward so that the screen (1) is spread in two directions and kept standstill in such a condition. By leaving a front portion of the screen (1) to hang downward parallel to the window surface, the screen (1) can provide a light shielding effect equivalent to that obtainable with the state of FIG. 1. An extended form of the screen (1) and (1*a*) in FIG. 19 correspond to the state of FIG. 4, an extended form of the screen (1*b*) correspond to the state of FIG. 5, and an extended form of the screen (1*c*) correspond to the state of FIG. 5.

The screen (1*c*) in the state of FIG. 6 is extended to entirely cover the window surface and serves also as a blind for protection of privacy, but hot air stagnates between the screen (1*c*) and the window surface, thus elevating an ambient temperature due to radiation heat. The state of FIG. 5 is obtained by pulling the horizontally moving rod (2) forward from the state of FIG. 6 to secure a vent space between the screen and the window surface. A sub-rod (53) is laid horizontally at an upper end of the storage case (9), shown in FIG. 19, while leaving a gap therebetween through which the screen (1) can pass, and both ends of the sub-rod (53) is fixedly engaged with side plates (54) fixed to the horizontally moving rod (2). The storage case (9) is detachably attached to the horizontally moving rod (2), and is moved away from and toward the window together with the horizontally moving rod (2) upon the arm links (3) being unfolded and folded. When only the storage case (9) is pulled downward and latched to a lower end of a window frame with the arm links (3) held in a storage state, the screen (1*c*) is stretched in the state shown in FIG. 6. When the horizontally moving rod (2) is pulled forward to a standstill position from the state of FIG. 6, the screen is held in the state of FIG. 5. Further, the screen is stretched in the state shown in FIG. 4 by pulling only the storage case (9) to spread the screen (1), operating a stopper device (not shown) disposed at the end of the storage case (9) to restrain the winding shaft from rotating backward, and then pulling the horizontally moving rod (2) forward and leaving it in a standstill position while turning the arm links (3) to unfold.

Figure 20:
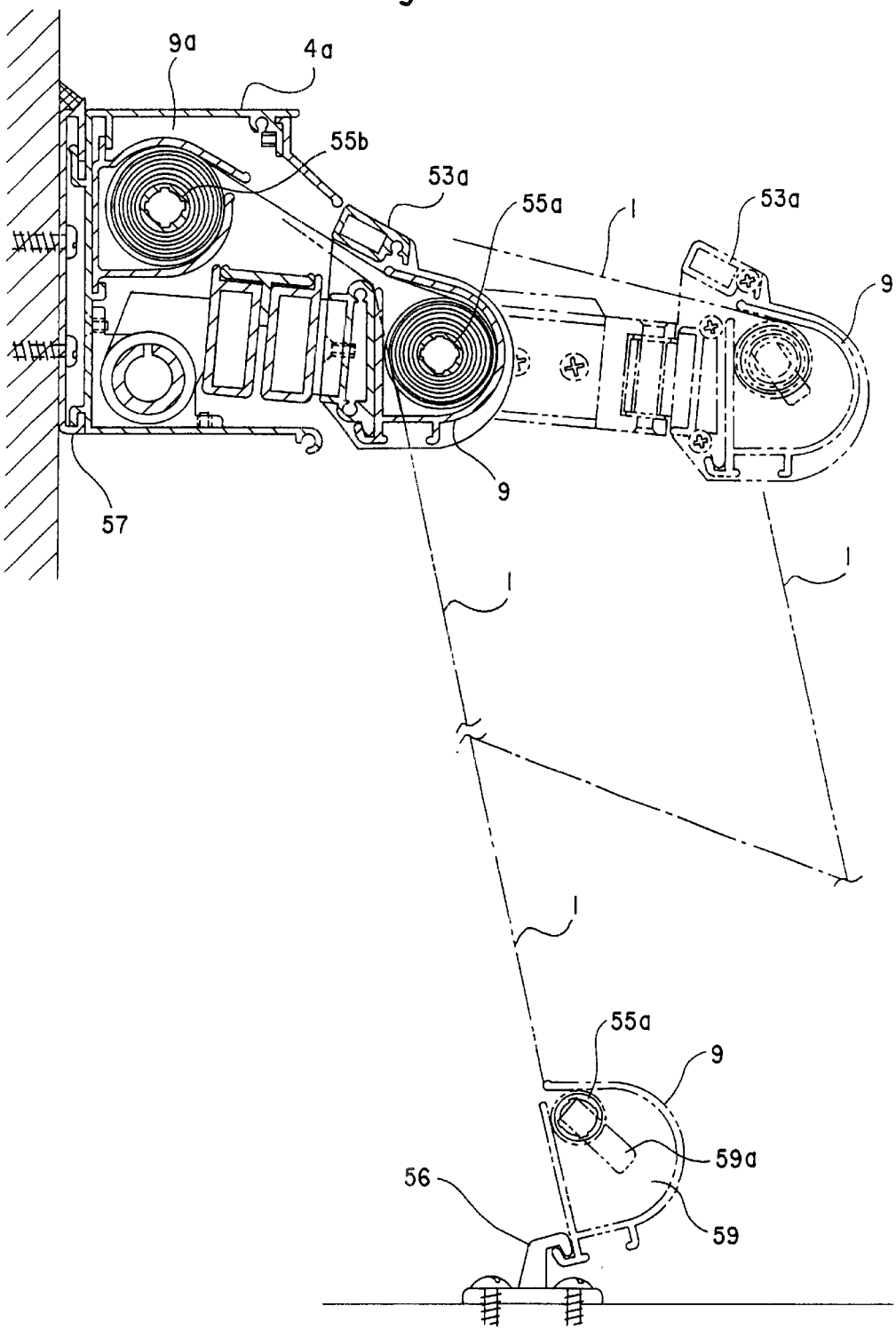
FIG. 20 is a side sectional view showing the states shown in FIGS. 2 and 3 where the sunshade roll screen is stretched downward and latched in place.

FIG. 20 is a sectional view showing a structure of the sunshade roll screen suitable for the case of installing the screen in a place where the screen is spread over a long distance as shown in FIGS. 2 and 3. In such a case, if the entire length of the screen is rolled up in one storage case (9), an outer diameter of the rolled-up screen becomes so large, and the storage case (9) must be increased to a size enough to accommodate the screen roll at a maximum diameter. As a result, a compact structure cannot be realized. Also, as the screen is spread over a longer distance, the number of rotations of the torsion spring incorporated in the winding shaft is increased and so does the resiliently biasing force of the torsion spring. Therefore, the force applied for retracting the screen in the state of the screen fully spread is so increased that smooth and light operability is impaired. A modification of FIG. 20 intends to improve such a drawback. A storage case (9*a*) detachably incorporated in a box case (4*a*) in a fixed position is provided separately from the storage case (9) detachably engaged with the horizontally moving rod (2). Winding shafts (55*a*) and (55*b*) are incorporated in the storage cases (9*a*) and (9), respectively. Leading and tailing ends of the screen (1) are fixedly bonded to the winding shafts (55*a*) and (55*b*), and substantially the same length of the screen (1) is wound over each of the winding shafts (55*a*) and (55*b*) to be accommodated in each of the storage cases (9*a*) and (9). When the horizontally moving rod (2) is pulled forward in such a condition, the screen (1) is unrolled to spread from one or both of the storage cases.

On the other hand, when rolling the screen (1) back from a fully spread state into the storage state, if the screen is early rolled up in either side, an outer periphery of the screen roll contacts with an inner wall surface of the storage case (9) or (9*a*). Therefore, the operation of further winding the screen (1) into one storage case is restrained due to the contact frictional force, and the remaining screen (1) is entirely rolled up and accommodated in the other storage case. This method of rolling up the long screen (1) over two winding shafts separately is advantageous in that the resiliently urging force of the torsion spring incorporated in each winding shaft is developed to such an extent as corresponding to the case of rolling up a screen having a half length of the long screen, and hence smooth and light operability can be achieved. Further, the outer diameter of the storage case is not increased, thus resulting in a compact structure. The screen spread states shown in FIGS. 2 and 3 intend to not only shield the sunlight coming in obliquely, but also exhibit a blind effect. Moreover, as shown in FIG. 20, the storage case (9) pulled down to a terrace is held there to keep the screen in the spread state by detachably engaging the storage case (9) to a metal fitting (56) fixed to the terrace, a movable block or the like. While the abovementioned box case (4) is fixedly disposed to the upper frame of the window sash, the box case (4*a*) may be detachably attached to an existing wall by directly fixing a bracket (57) to the wall.

Figure 21:
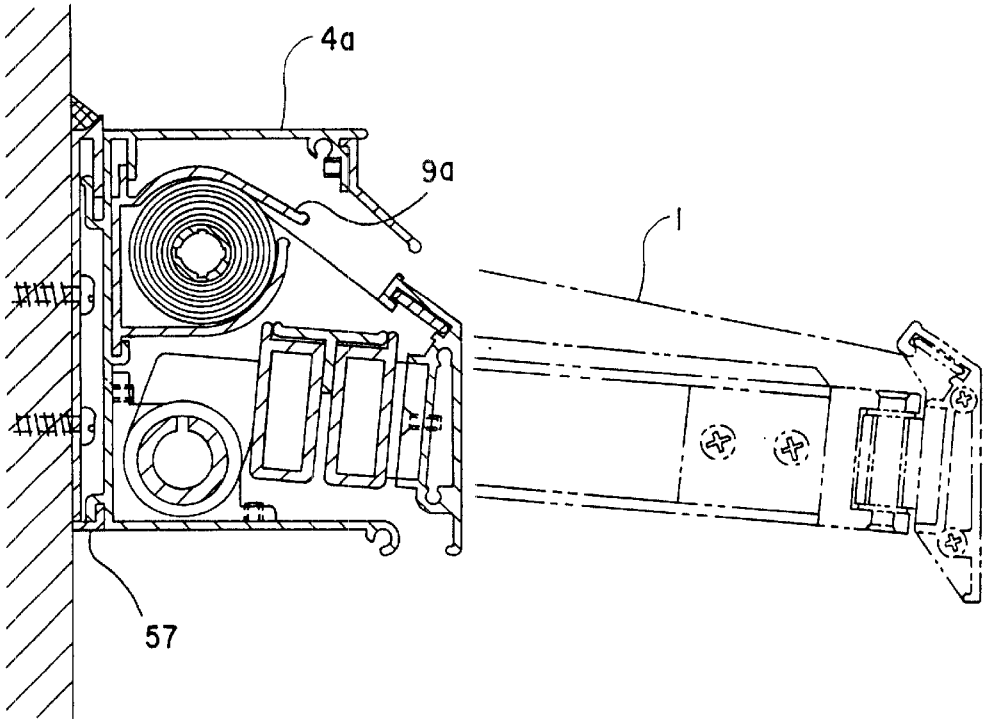
FIG. 21 is a side sectional view of a roll screen according to a modification of the present invention in which the storage case is provided on the side of a wall surface.

FIG. 21 shows another modification wherein the storage case is housed in the box case (4*a*) fixed to the wall surface and the leading end of the screen (1) is bonded to the horizontally moving rod contrary to the above embodiment wherein the storage case is detachably engaged with the horizontally moving rod. This modification is advantageous in that when arm links having a low degree of bending strength are employed, the weight of a fore end portion of the screen is lessened and a burden imposed on the arm links is reduced.

Figure 22:
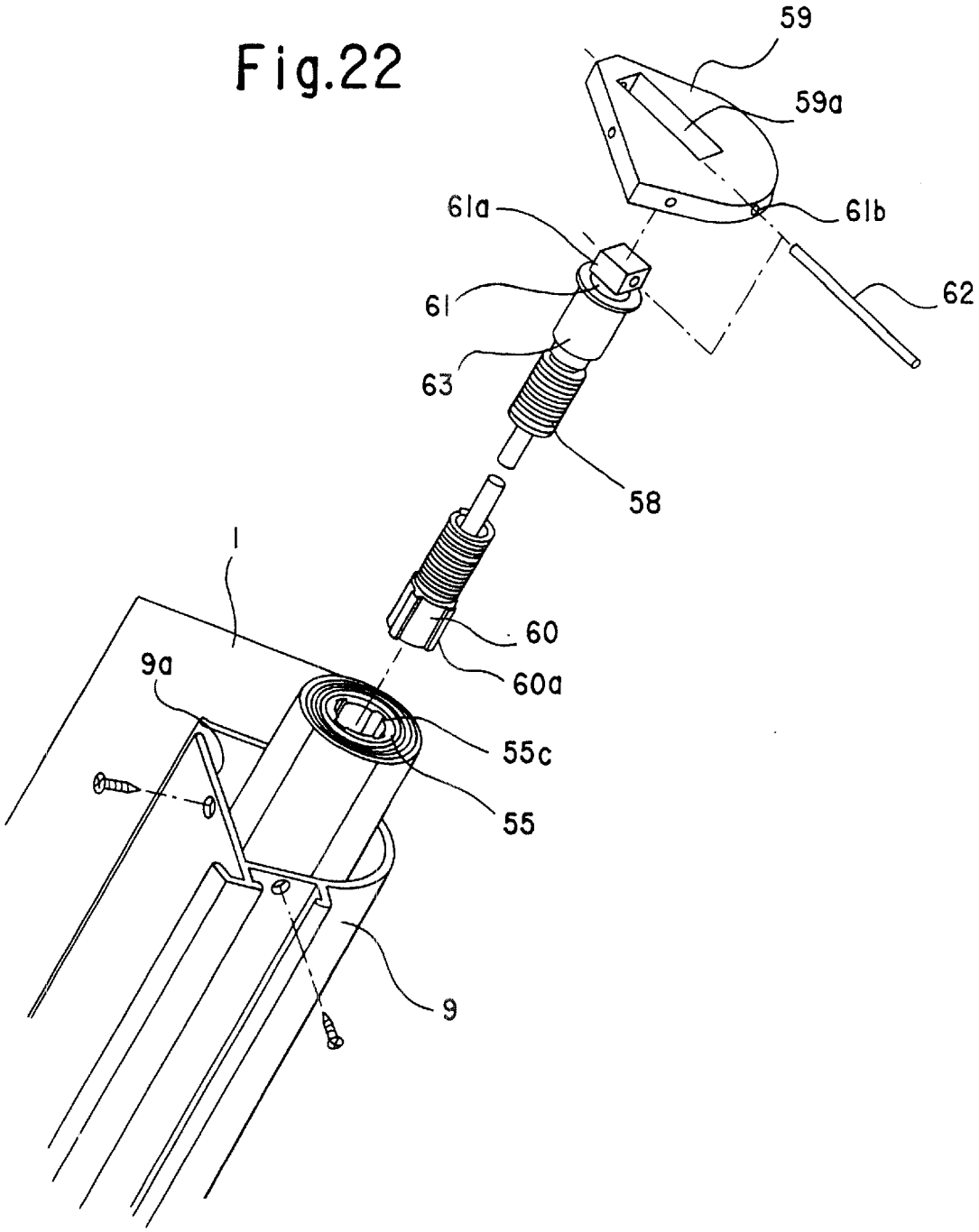
FIG. 22 is a partial exploded perspective view of the roll screen according to the present invention, showing a torsion spring incorporated in a winding shaft, and other components.

FIG. 22 is a partial exploded perspective view showing a torsion spring (58) incorporated in the winding shaft (55), and a cover plate (59) engaged with the end of the storage case (9) and having a shaft slot (59*a*) for guiding an axis of the winding shaft (55) when it moves. A slit (55*c*) is formed in an inner peripheral surface of the winding shaft (55), and a rib (60*a*) on a spring terminal (60) fixed to one end of the torsion spring (58) is fitted into the slit (55*c*) to prevent the winding shaft (55) from rotating idly. A shaft (61) secured to the other end of the torsion spring (58) is attached to a collar (63) which is fitted into the winding shaft (55). An end of the shaft (61) is formed into a square head (61*a*) which is slidably fitted in the cover plate slot (59*a*). In addition, a shaft (62) is inserted through a shaft hole (61*b*) and penetrates the square head (61*a*) to support it from disengaging from the slog (59*a*), whereby the shaft 61 is restrained from rotating. Accordingly, as the screen (1) rolled up over the winding shaft (55) is unrolled and the outer diameter of the screen roll is reduced, the winding shaft (55) is pulled by the screen such that the outer periphery of the screen roll continues contacting with the inner wall surface (9*a*) of the storage case (9), whereupon the winding shaft (55) is also moved correspondingly. In other words, the slot (59*a*) is formed at an angle in match with a moving direction of the axis of the winding shaft (55), and the square head (61*a*) projecting from the end of the winding shaft (55) is guided by the slot (59*a*) to move along it. Conversely, when the screen (1) is rolled up into the storage case (9), the square head (61*a*) is moved to the center of the storage case (9) along the slot (59*a*) while the outer periphery of the screen roll is pushed by the inner wall surface (9*a*) of the storage case (9) in a sliding contact state.

As described above, the present invention has the following superior advantages.

1) The horizontally moving rod supporting the screen is movable in a condition where it is always itself kept in a parallel relation with respect to the wall surface without wobbling laterally. Therefore, the screen can be spread and retracted by pulling any part of the horizontally moving rod forward, and a speedy simple operation can be achieved.
2) Since the horizontally moving rod is itself movable in a parallel relation irrespective of expansion and contraction of screen cloth, the screen cloth can be made of a piece of thin cloth and hence has light weight. Therefore, associated components can be reduced in weight and size so as to achieve a smooth and light operation and to facilitate transport of the screen before installation and mounting work for the installation.
3) Since a flexible, small-diameter winding shaft has light weight and a force required rotating the winding shaft itself is small, the magnitude of a resiliently urging force of a torsion spring can be utilized to effect the operation of rolling up the screen cloth. Therefore, the torsion spring can be reduced in small and size. In addition, in a condition where the thin screen cloth is rolled up over the small-diameter winding shaft, a resulting screen roll also has a small diameter. The storage case can be finished to be small in diameter and compact. A space necessary for installation onto the wall surface can be reduced. It is easy to carry out maintenance, particularly to remove and clean the screen.
4) Since the screen can spread not in only an oblique horizontal direction, but in two directions including a vertical direction parallel to the window surface, the screen is adaptable for changes in angle of the incident light depending on the height of the sun, and also has an effect for protection of privacy because it can serve as a blind.
5) In particular, even when the screen is forgotten from being closed and left in the spread state, or the screen in the spread state is blown by a rush of wind, the safety device is actuated to retract the screen to a fully closed state or a safe spread length in a moment (0.5 to 1 second). As a result, the components and the wall surface, to which the screen is installed, can be kept from being damaged.

What is claimed is:

1. A sunshade roll screen comprising:

a support adapted to be fixed to a wall;

a movable horizontal rod;

at least two collapsible arm systems, each including first and second gears positioned to mesh with each other, a first link being connected in a hinged manner to said support at a first end of said first link, and connected to said first gear at a second end of said first link, and a second link being connected in a hinged manner to said movable horizontal rod at a first end of said second link, and connected to said second gear at a second end of said second link;

a connecting rod connected in a hinged manner to each of said at least two collapsible arm systems;

a roll screen capable of being rolled and unrolled;

a support hinge slidably connected to said support;

a restraining link having a first end connected in a hinged manner to one of said links and having a second end connected to said support hinge;

a trigger provided in said support, extending in a sliding path of said support hinge to engage said support hinge, thereby preventing movement of said support hinge in a direction along said support; and disengagement means for disengaging said triger to allow said support hinge to slide past said trigger; wherein said support, said movable horizontal rod, said at least two collapsible arm systems, and said connecting rod form a framework to which said roll screen is attached, said at least two collapsible arm systems are extendable from and collapsible towards said support, and said roll screen is adapted to unroll and roll respectively in conjunction with an extension and a collapsing of said at least two collapsible arm systems.

2. The sunshade roll screen of claim 1, wherein said trigger includes a main body and a leaf spring mounted on said main body and extending in the sliding path of said support hinge.

3. The sunshade roll screen according to claim 1, further comprising:

a rod located within said support, connected to an end of said trigger to pull said trigger into said support, thereby allowing said support hinge to slide past said trigger.

4. The sunshade roll screen according to claim 1, wherein said support includes a rotatable first support pipe and a fixed second support pipe; and said sunshade roll screen further comprises:

a fixed holder rotatably supporting said first support pipe;

said support hinge slidably connected to said second support pipe;

said trigger provided in said second support pipe;

a spring, connected to said trigger to urge said trigger to extend in a sliding path of said support hinge to engage said support hinge, thereby preventing movement of said support hinge in a direction along said second support pipe; and a drive shaft located within said second support pipe, coupled at a first end to rotate with said first support pipe and having a second end located at a support position to support said trigger in substantially the same direction in which said trigger is urged by said spring when said first support pipe is in a predetermined position;

wherein, when said first support pipe rotates out of the predetermined position, said second end of said drive shaft moves from the support position, thereby removing support from said trigger, allowing said support hinge to slide past said trigger.

5. The sunshade roll screen according to claim 4, further comprising:

a rod located within said second support pipe, connected to an end of said trigger to pull said trigger into said second support pipe, thereby allowing said support hinge to slide past said trigger.

6. A sunshade roll screen comprising:

a support adapted to be fixed to a wall;

a movable horizontal rod;

at least two sliding shoes slidably connected to said movable horizontal rod;

at least two rack gears, each rack gear of said at least two rack gears respectively connected to a corresponding sliding shoe;

an idle gear held in mesh with said at least two rack gears;

at least two links, each link connected in a hinged manner to said support, and connected in a hinged manner to a corresponding sliding shoe;

a roll screen capable of being rolled and unrolled; wherein said support, said movable horizontal rod, said at least two links form a framework to which said roll screen is attached, said at least two links are extendable from and collapsible towards said support, and said roll screen is adapted to unroll and roll respectively in conjunction with an extension and a collapsing of said at least two links.

7. A sunshade roll screen of claim 6, wherein said roll screen includes:

a hollow winding shaft;

a screen wound over said hollow winding shaft, having a first end fixed to said hollow winding shaft, and a second end fixed to a box case in which said support is housed;

a torsion spring positioned within said hollow winding shaft; and a storage case housing said hollow winding shaft and screen, and having a slit through which said screen is guided wherein a part of said screen which is wound over said hollow winding shaft has a diameter which is changed as said screen is rolled and unrolled and is supported by an interior wall surface of said storage case.

8. The sunshade roll screen of claim 6, wherein said support is a support pipe.

9. The sunshade roll screen of claim 8, wherein said support pipe is rotatably mounted within a box case, and wherein said sunshade roll screen further comprises:

at least one coiled spring disposed to restrain said support pipe from rotating forward and backward with respect to said box case when said at least two links and screen are extended at a predetermined location.

10. The sunshade roll screen according to claim 6, further comprising:

a support hinge slidably connected to said support;

a restraining link having a first end connected in a hinged manner to one of said links and having a second end connected to said support hinge;

a trigger provided in said support, extending in a sliding path of said support hinge to engage said support hinge, thereby preventing movement of said support hinge in one direction along said support;

disengagement means for disengaging said trigger to allow said support hinge to slide past said trigger.

11. The sunshade roll screen according to claim 10, wherein said trigger includes a main body and a leaf spring mounted on said main body and extending in the sliding path of said support hinge.

12. The sunshade roll screen according to claim 6, further comprising:

a support hinge slidably connected to said support;

a restraining link having a first end connected in a hinged manner to one of said links and having a second end connected to said support hinge;

a trigger provided in said support, extending in a sliding path of said support hinge to engage said support hinge, thereby preventing movement of said support hinge in a direction along said support; and a rod located within said support, connected to an end of said trigger to pull said trigger into said support, thereby allowing said support hinge to slide past said trigger.

13. The sunshade roll screen according to claim 6, wherein said support includes a rotatable first support pipe and a fixed second support pipe, and said sunshade roll screen further comprises:

a fixed holder rotatably supporting said first support pipe;

a support hinge slidably connected to said second support pipe;

a restraining link having a first end connected in a hinged manner to one of said links and having a second end connected to said support hinge;

a trigger provided in said second support pipe;

a spring, connected to said trigger to urge said trigger to extend in a sliding path of said support hinge to engage said support hinge, thereby preventing movement of said support hinge in a direction along said second support pipe; and a drive shaft located within said second support pipe, coupled to rotate with said first support pipe at a first end and having a second end located at a support position to support said trigger in substantially the same direction in which said trigger is urged by said spring when said first support pipe is in a predetermined position;

wherein when said first support pipe rotates out of the predetermined position, said second end of said drive shaft moves from the support position, thereby removing support from said trigger, allowing said support hinge to slide past said trigger.

14. The sunshade roll screen according to claim 13, further comprising:

a rod located within said second support pipe, connected to an end of said trigger to pull said trigger into said second support pipe, thereby allowing said support hinge to slide past said trigger.

15. The sunshade roll screen of claim 6, wherein said at least two links comprises only two links.

* * * * *